US006338624B1

(12) United States Patent
Kim

(10) Patent No.: US 6,338,624 B1
(45) Date of Patent: Jan. 15, 2002

(54) AUTOMATIC PUTTING-OUT APPARATUS

(75) Inventor: Yoon-Guk Kim, KyongGi-Do (KR)

(73) Assignee: Paseco Co., Ltd. (KR)

( * ) Notice: Subject to any disclaimer, the term of this patent is extended or adjusted under 35 U.S.C. 154(b) by 0 days.

(21) Appl. No.: 09/613,621

(22) Filed: Jul. 11, 2000

(30) Foreign Application Priority Data

Jun. 9, 2000 (KR) ..... 00-31534

(51) Int. Cl.[7] ..... F23N 5/04

(52) U.S. Cl. ..... 431/33; 431/88; 431/317; 236/1 H

(58) Field of Search ..... 431/33, 34, 88, 431/304, 315–317; 236/1 A, 1 H; 126/96

(56) References Cited

U.S. PATENT DOCUMENTS 4,664,095 A * 5/1987 Takahashi et al. ..... 431/33
4,797,088 A * 1/1989 Nakamura et al. ..... 431/88

FOREIGN PATENT DOCUMENTS

JP 41-12269 6/1966
JP 59-202322 11/1984
JP 60-122826 7/1985
JP 61-116218 6/1986
JP 63-279020 11/1988
JP 5-248611 A * 9/1993

* cited by examiner

*Primary Examiner*—Sara Clarke
(74) *Attorney, Agent, or Firm*—Dinesh Agarwal, P.C.

(57) ABSTRACT

An automatic combustion putting-out apparatus for a room heater, includes wick case with a turning shaft to raise or lower a wick, a torsion-spring biased ratchet, a lever pivotally mounted in a frame for releasing or arresting the ratchet, a shutting-off knob and a safety weight for actuating the lever to release the ratchet for putting-out a combustion, a bracket on one side of the frame, a blocking plate pivotally mounted on the bracket and provided with an actuating piece to be in contact with a bottom surface of the lever, a coil spring for actuating the blocking plate by returning to its original shape when the room temperature rises beyond a predetermined value to interrupt combustion, the coil spring being connected to the blocking plate and the bracket by opposite ends of the spring, and a bias spring for boosting the force of the coil spring when the coil spring is initiated at beyond the predetermined room temperature value, the bias spring being connected to the blocking plate and the bracket by opposite ends of the bias spring. The apparatus turns off the heater automatically when the room temperature reaches a predetermined level to protect the heater from overheating to prevent fire, and to reduce indoor air pollution thereby enhancing health as CO and $CO_2$ levels in the room are controlled to within safe limits.

11 Claims, 10 Drawing Sheets

AUTOMATIC PUTTING-OUT APPARATUS

FIELD OF THE INVENTION

The present invention relates to an automatic putting-out apparatus and particularly to an automatic putting-out apparatus which can be used to control room heating by automatically interrupting combustion when the room temperature reaches a predetermined temperature.

BACKGROUND OF THE INVENTION

A variety of fire putting-out means have been developed so far in the field of room heating, which can put off heating apparatuses when the room temperature reaches a certain level.

As an example, a Japanese patent publication 41/12269 discloses a heating controller wherein the flow of fuel through a main combustion device is controlled by operating a control valve in a bleed line to adjust the pressure depending on the room temperature. This system, however, is not suited for practical use because it includes so many different components like pressure controllers, several valves, lever devices with temperature-responding members and supporting means to maintain the lever devices at neutral position that responding speed is not only slow but also its construction is very complicated and costly.

As another typical type widely used in many countries, there are fire extinguishers based on bimetals in which a power switch is operated based on a bimetal plate to actuate a motor to shift operating load through rotary movement of an eccentric cam to thereby interrupt ignition. This kind of system is also associated with drawbacks in that an electric circuit comprising an connector to operate a motor by bending bimetal through heating based on the difference in thermal expansion of metals is needed and further both a device for interrupting combustion and a mechanism for initiating combustion are required, resulting in complex operation and high manufacturing cost.

SUMMARY OF THE INVENTION

Under the circumstances stated above, the present inventors made an intensive effort to develop an automatic putting-out apparatus which is simple in construction and easy in operation to be adapted for practical embodiment and which can contribute to improvement in human health by controlling the levels of harmful gases like carbon monoxide and carbon dioxide in the air in a room where the heater is installed as well as the room temperature within acceptable levels. As the result, an automatic putting-out apparatus which can fulfill the sought desire in spite of a simple structure has been devised.

The present invention takes the advantage of a property of a shape-memory alloy which restores its original shape at the critical temperature intrinsic of the material of the alloy regardless of its ability to deform freely below that temperature to actuate the switching means of the putting-out apparatus in response to a certain elevated temperature. The approximate relation of the accumulation of harmful indoor gases with the room temperature is also used. Thus, the object of the present invention is to provide an automatic putting-out apparatus which is reliable to operate for prevention of overheating or fire and for preserving human health and is simple to construct by using a shape-memory alloy, is manufactured at a low cost mainly because of elimination of electric power and motor and can be operated irrespective of electric power failure.

BRIEF DESCRIPTION OF THE DRAWINGS

An automatic putting-out apparatus according to the first embodiment of the present invention is represented in FIGS. 1 to 5*b*, of which.

Figure 6:
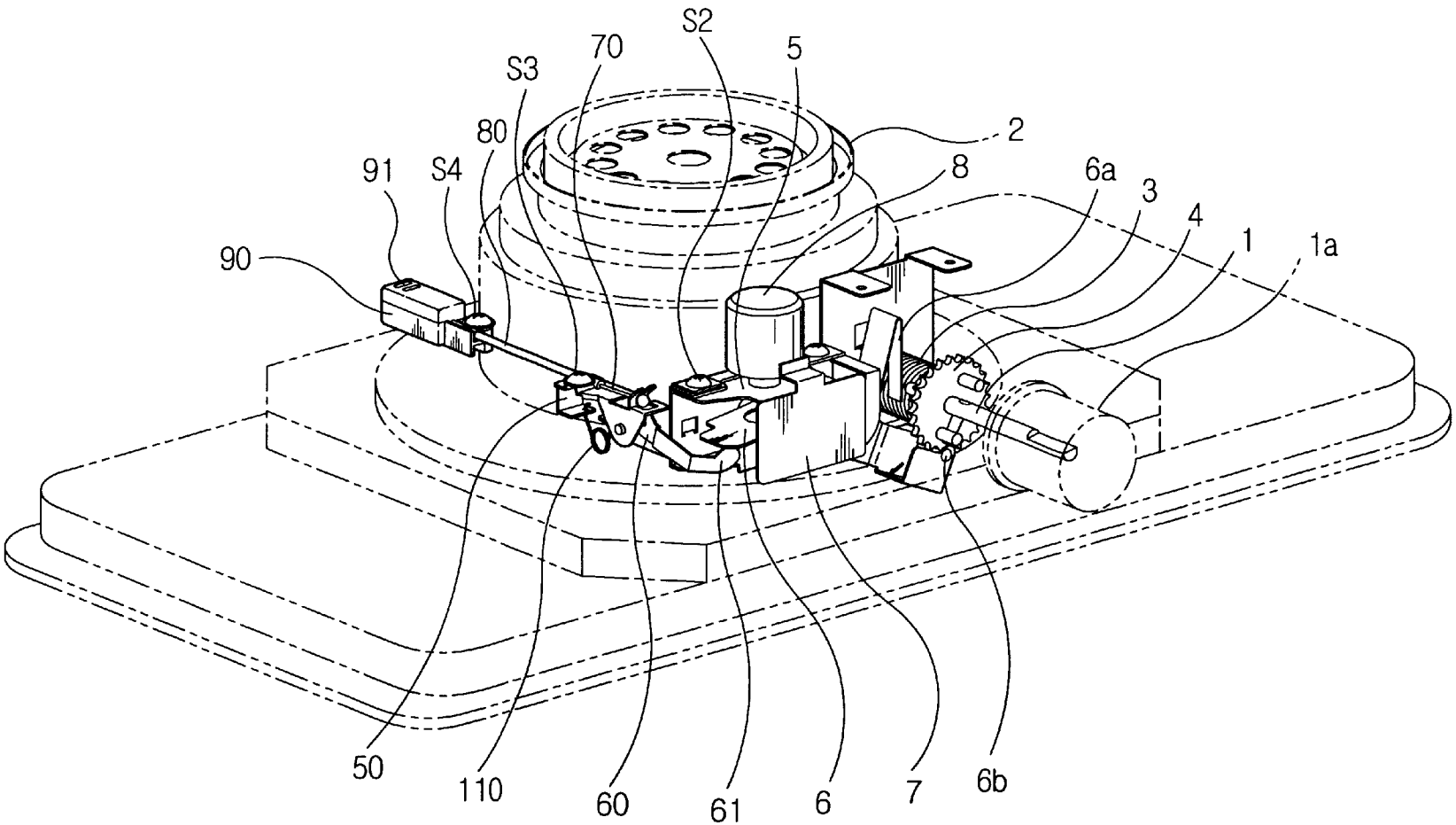
Figure 7:
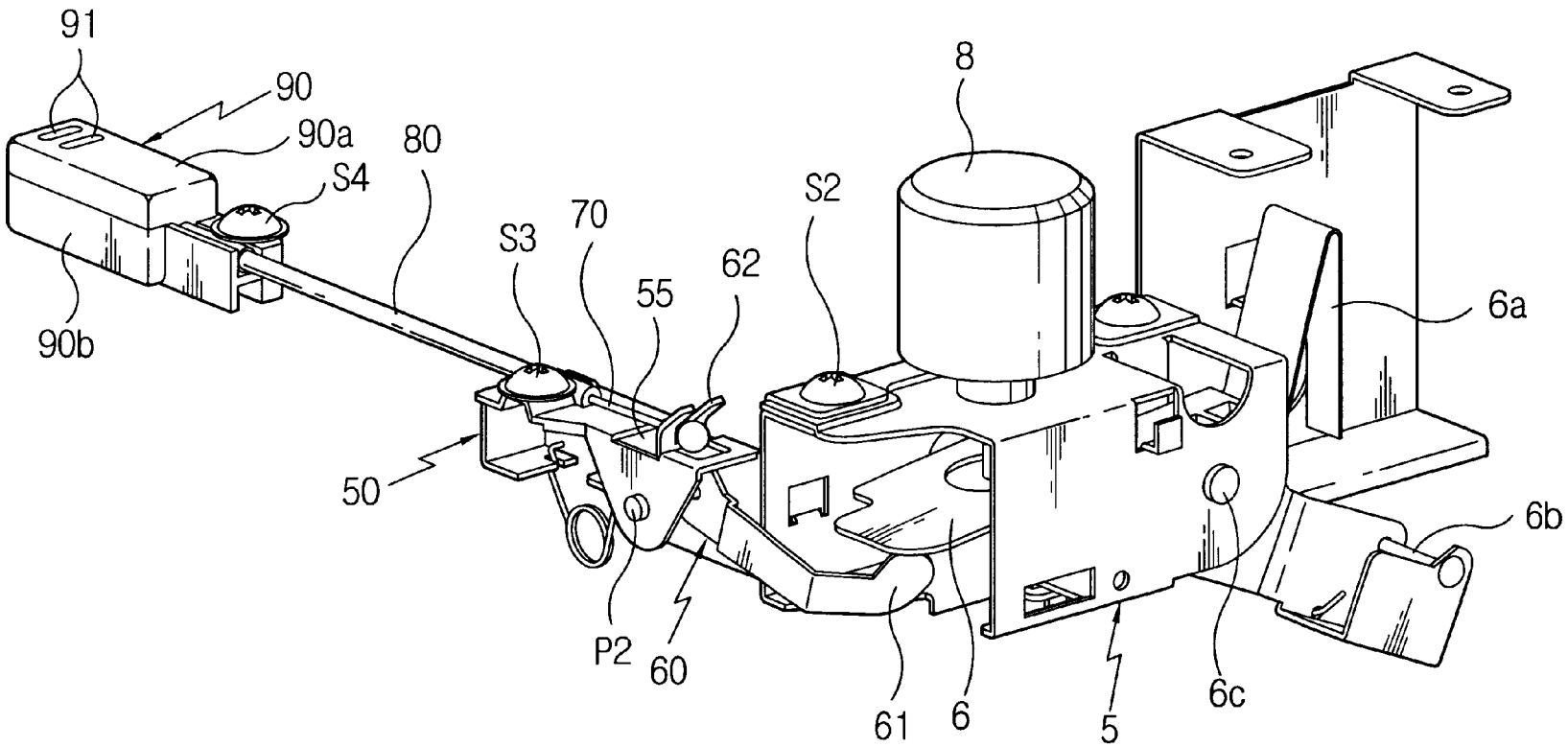
Figure 8:
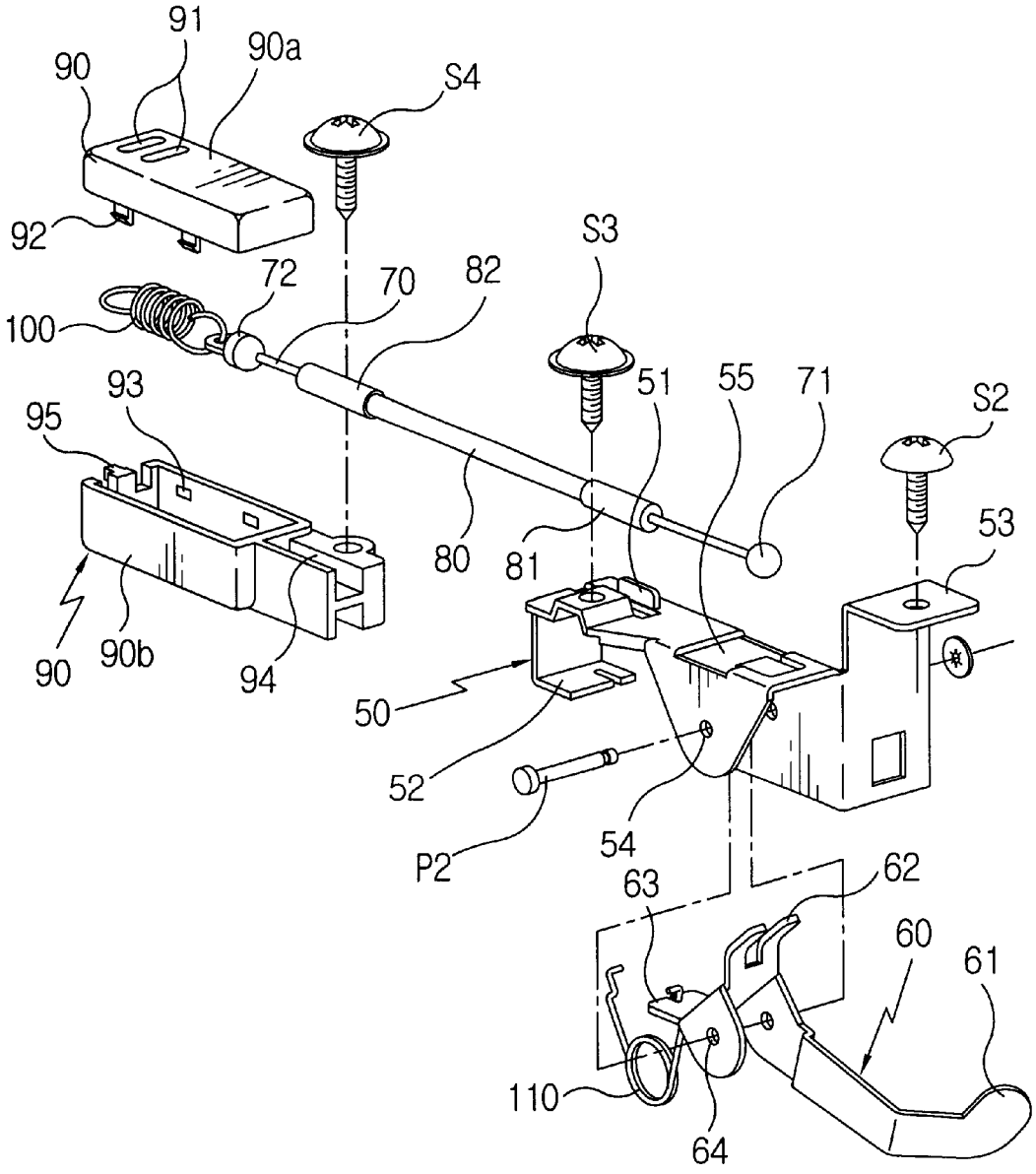
Figure 9A:
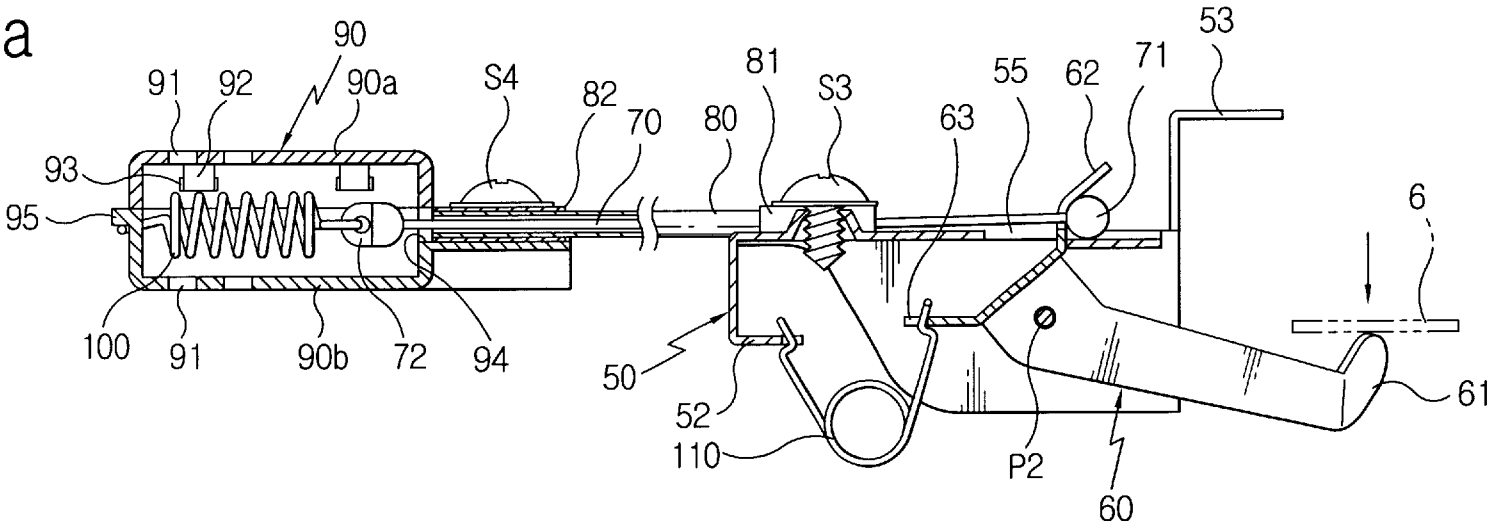
Figure 9B:
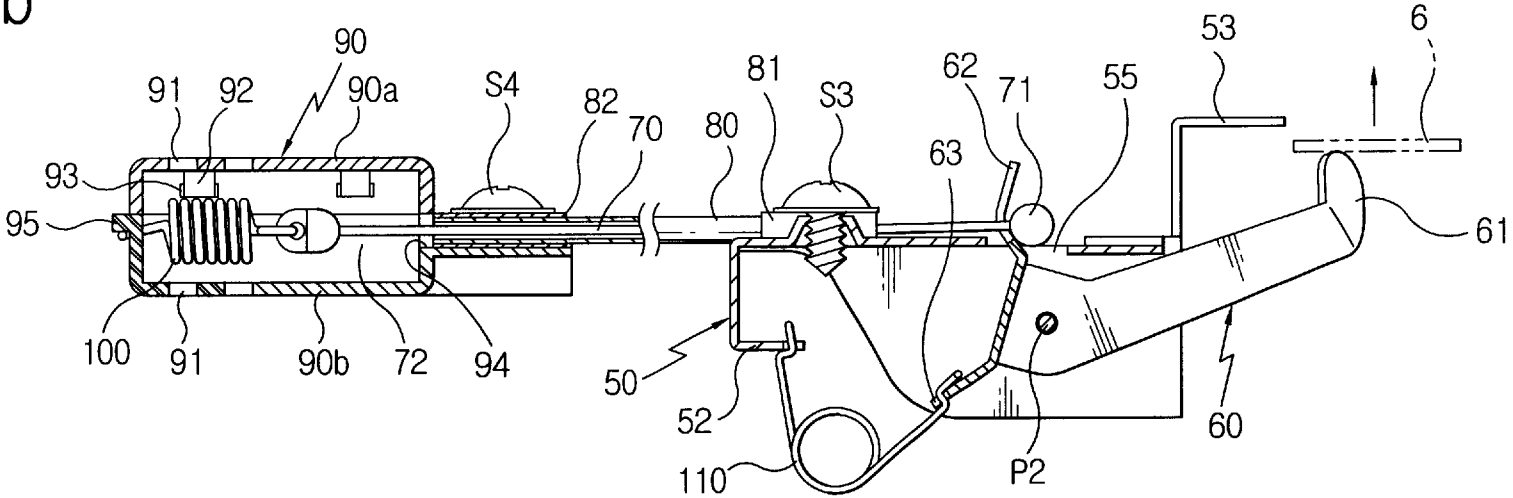
Figure 10A:
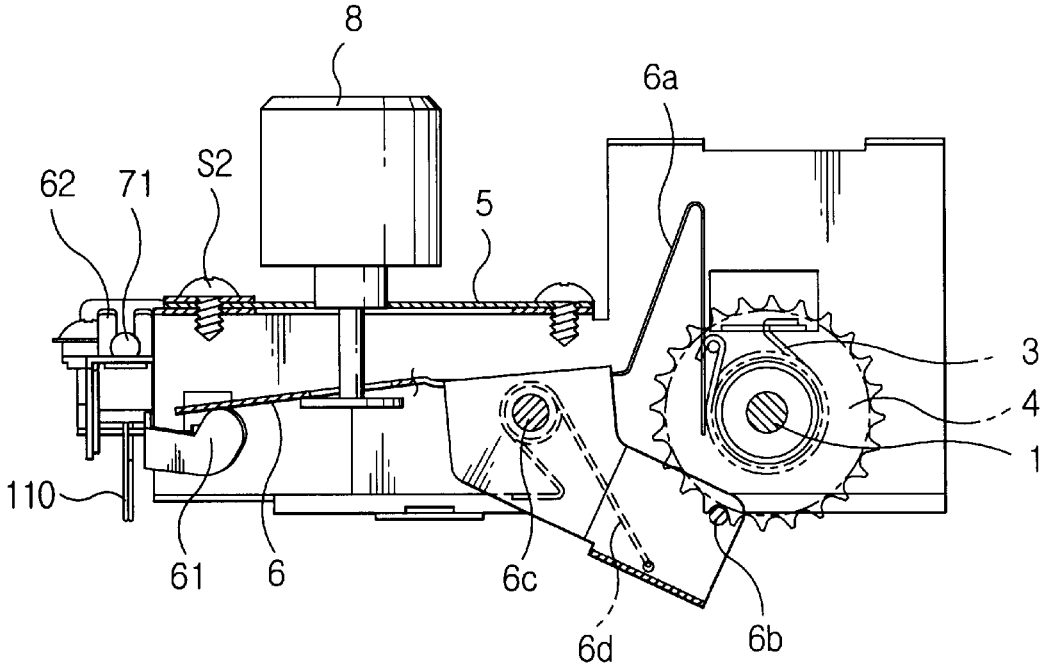
Figure 10B:
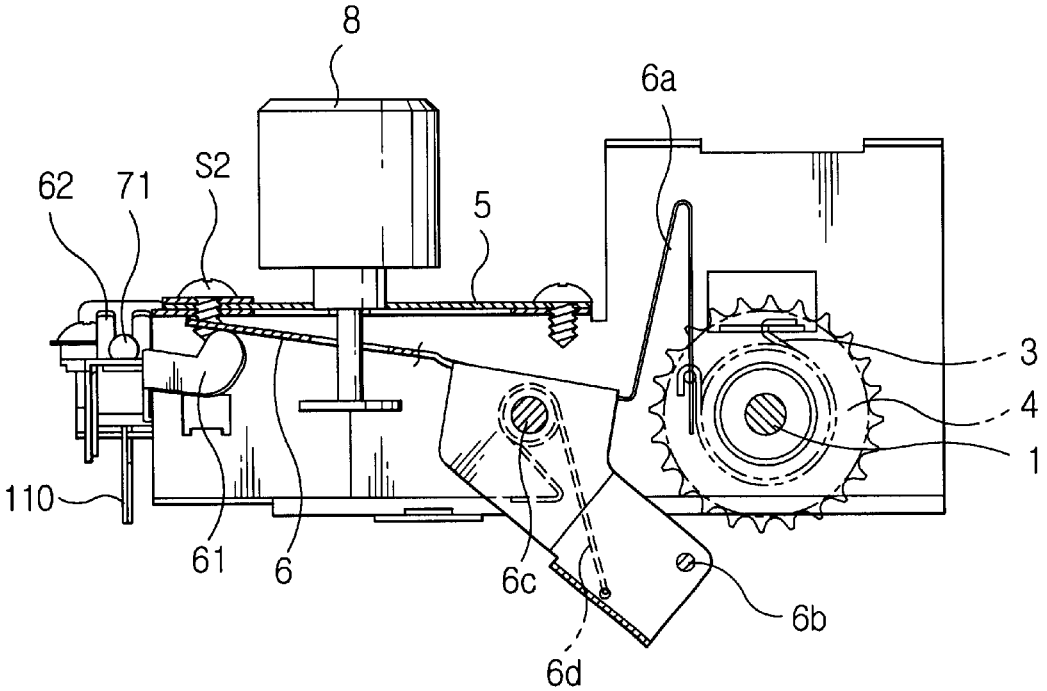

An automatic putting-out apparatus according to the second embodiment of the present invention is represented in FIGS. 6 to 10*b*, of which:

FIG. 6 shows the present invention in installed state,

FIG. 7 shows the perspective view of the present invention,

FIG. 8 shows an exploded perspective view of a major part of the invention,

FIGS. 9*a* and 9*b* show the operative states of the present invention and FIGS. 10*a* and 10*b* show the operative states of the lever in the present invention.

DETAILED DRAWINGS OF THE INVENTION

The invention will be described in detail below by referring to the accompanying drawings.

Figure 5A:
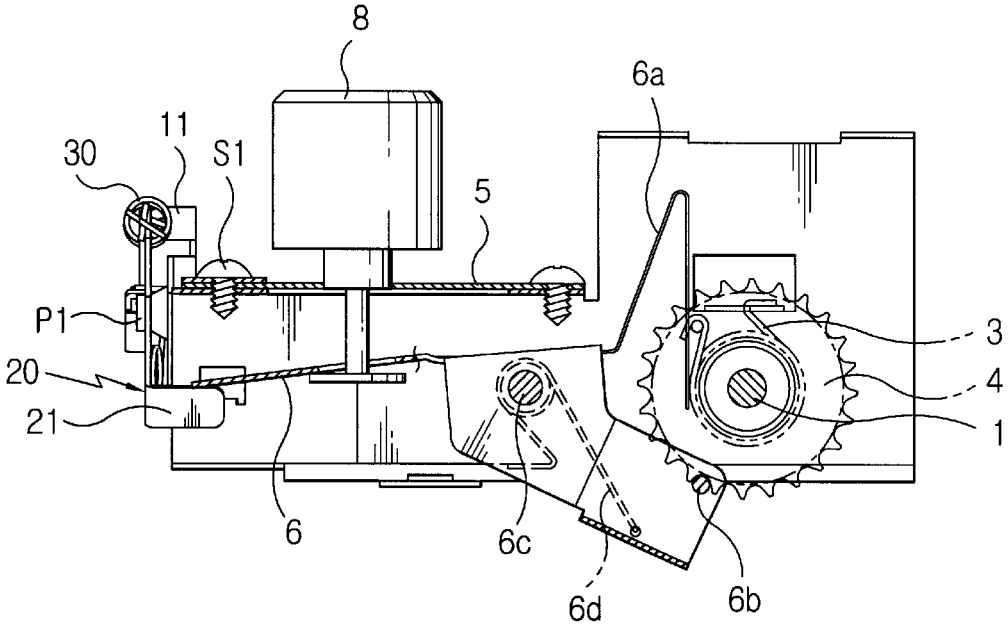
Figure 5B:
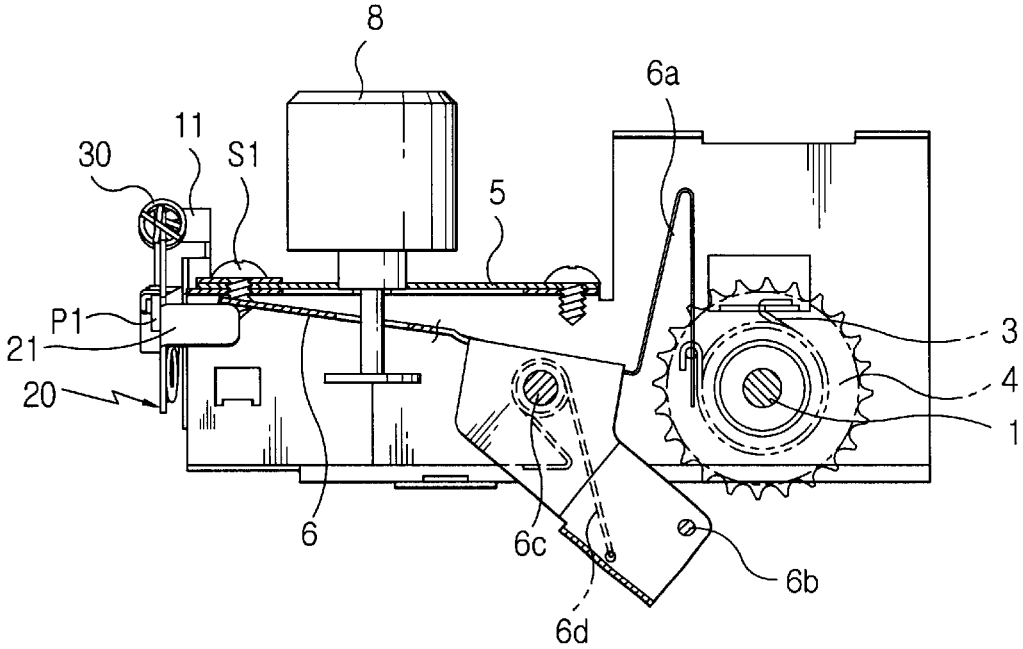

First, an automatic putting-out apparatus according to the first embodiment of the present invention is described with reference to FIGS. 1 to 5*b*.:

The rotary shaft 1 is securely provided with a grip 1*a*, which can be turned clockwise to raise a wick or wicks in a wick case 2, wherein the rotary shaft 1 is prevented from reverse rotation due to a ratchet 4 with a lever 6, as seen best in FIG. 5*a*.

A shutting-off knob 7 and a safety weight 8 are arranged on a frame 5, beside the lever 6. The lever 6 is provided with a switching bar 6*b* at a position on its leading end part, which bar serves to prevent reverse rotation of the ratchet 4 when it is engaged with the ratchet 4 under the elastic force of a leaf spring 6*a*. The lever 6 is mounted on a lever shaft 6*c* pivotally in a frame 5, which lever shaft is provided with a torsion bar 6*d*. The lever shaft 6*c* spans the opposite walls of the frame 5.

The lever 6 is disposed pivotally and elastically through a torsion spring 6*d* arranged around the lever shaft 6*c*, as also seen clearly in FIG. 5*a* or *b*. When the lever 6 is raised on the left side of the drawings, the blocking bar 6*b* which was locked on the ratchet 4 is lowered to leave the ratchet 4, freeing it. Then, the rotation shaft 1 which has been rotated clockwise is now turned anticlockwise due to the torque of a torsion spring 3 mounted on the shaft 1 to return to the original state, whereby the wick 2 is lowered to extinguish the combustion.

The switching knob 7 which can be used to interrupt the combustion as required is provided elastically on the front side of the frame 5. When the knob 7 is pressed down, the lever 6 is raised to free the ratchet 4 through the switching bar 6*b* to thereby perform putting-out, as described above.

A safety weight 8 which is a safety measure intended to prevent a fire for a possible case of the heating apparatus being tilted or moved is arranged on the top of the frame 5 so that this weight may be tilted in any direction and extends down through the lever 6 at a position on the outer side of the lever shaft 6*c*. Thus, any considerable inclination of the safety weight 8 with the inclination of the heating apparatus would actuate the lever 6 to ascend so that automatic putting-out may be conducted as described above.

Figure 1:
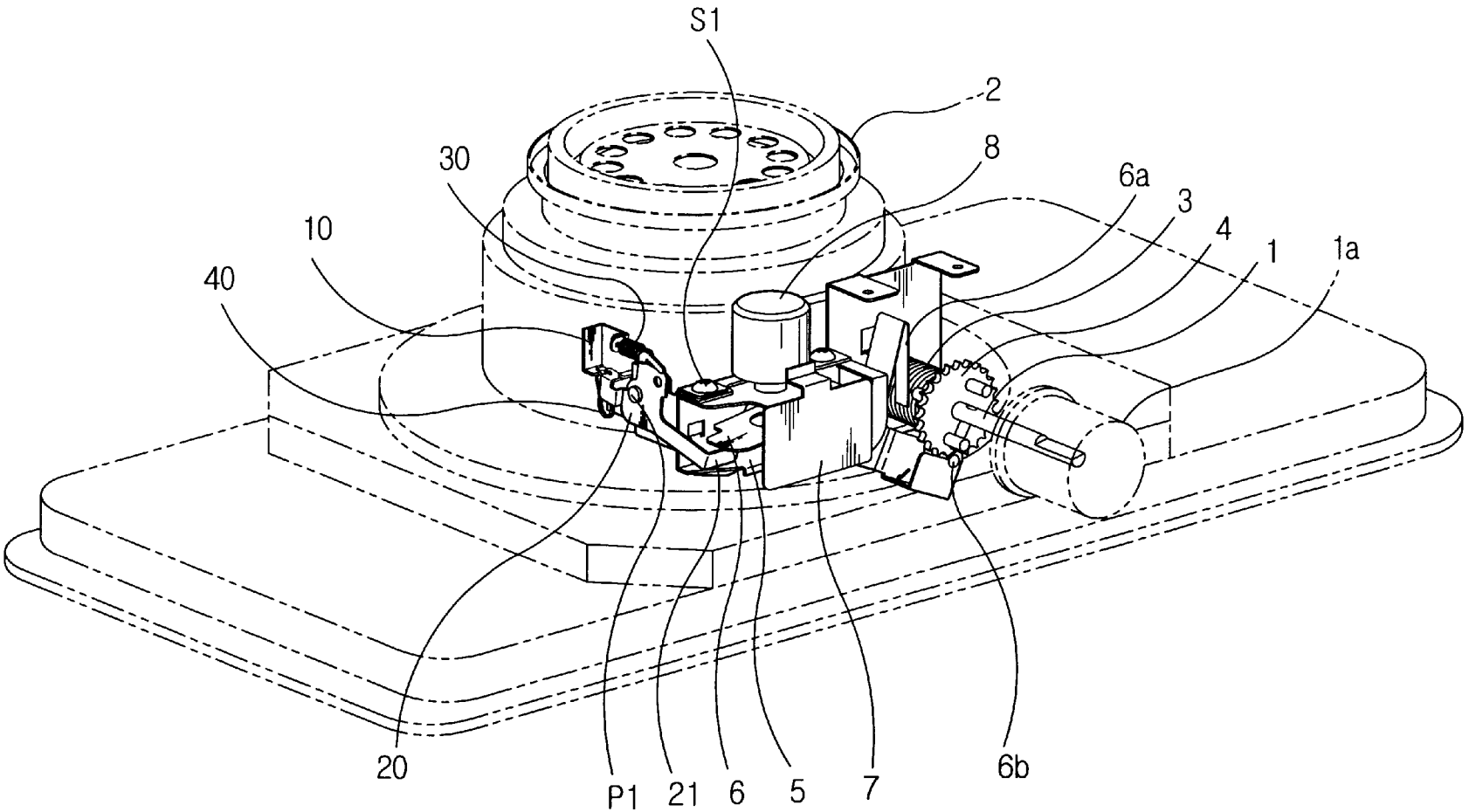
FIG. 1 shows the present invention in installed state.
Figure 2:
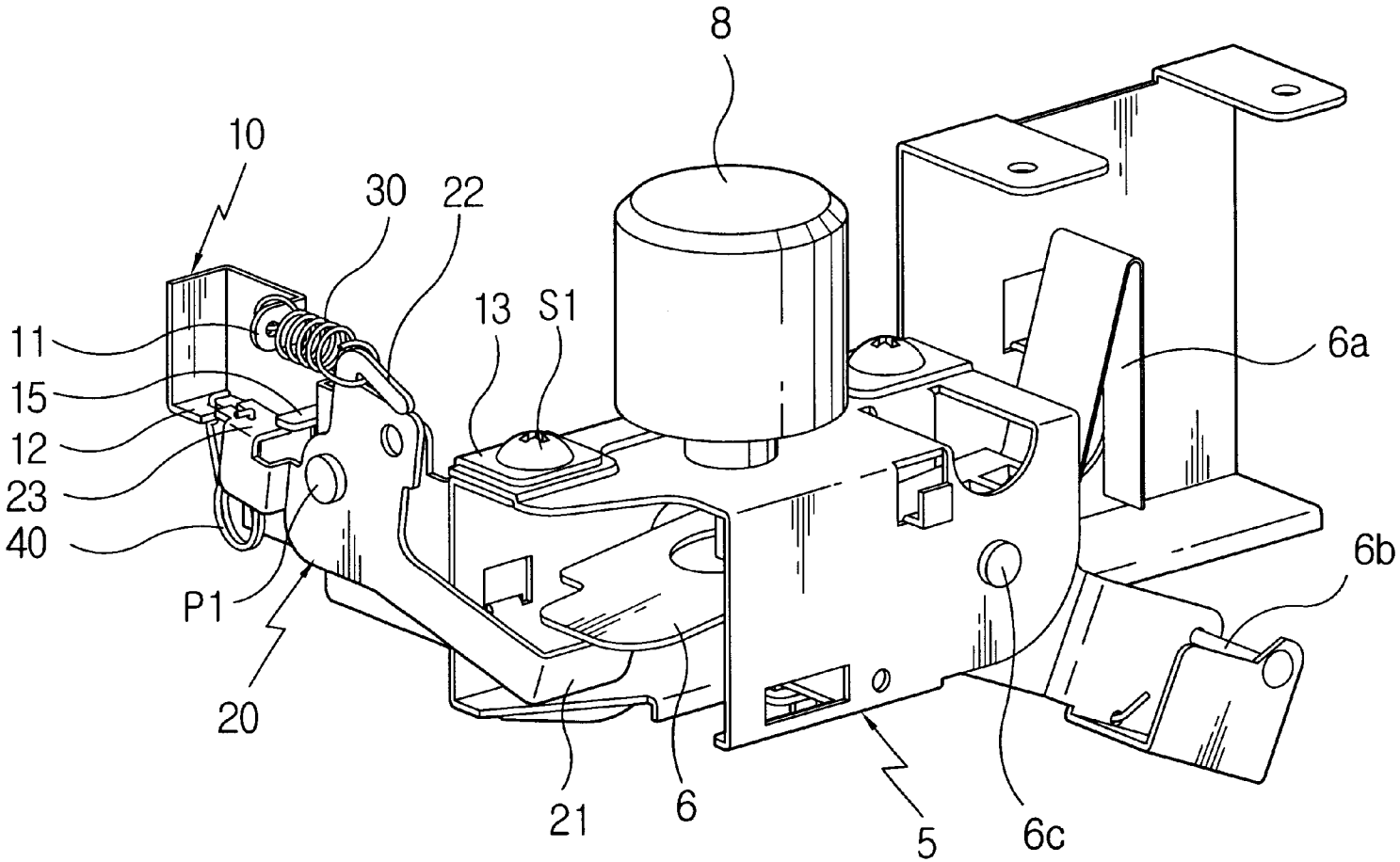
FIG. 2 shows the perspective view of the present invention.
Figure 3:
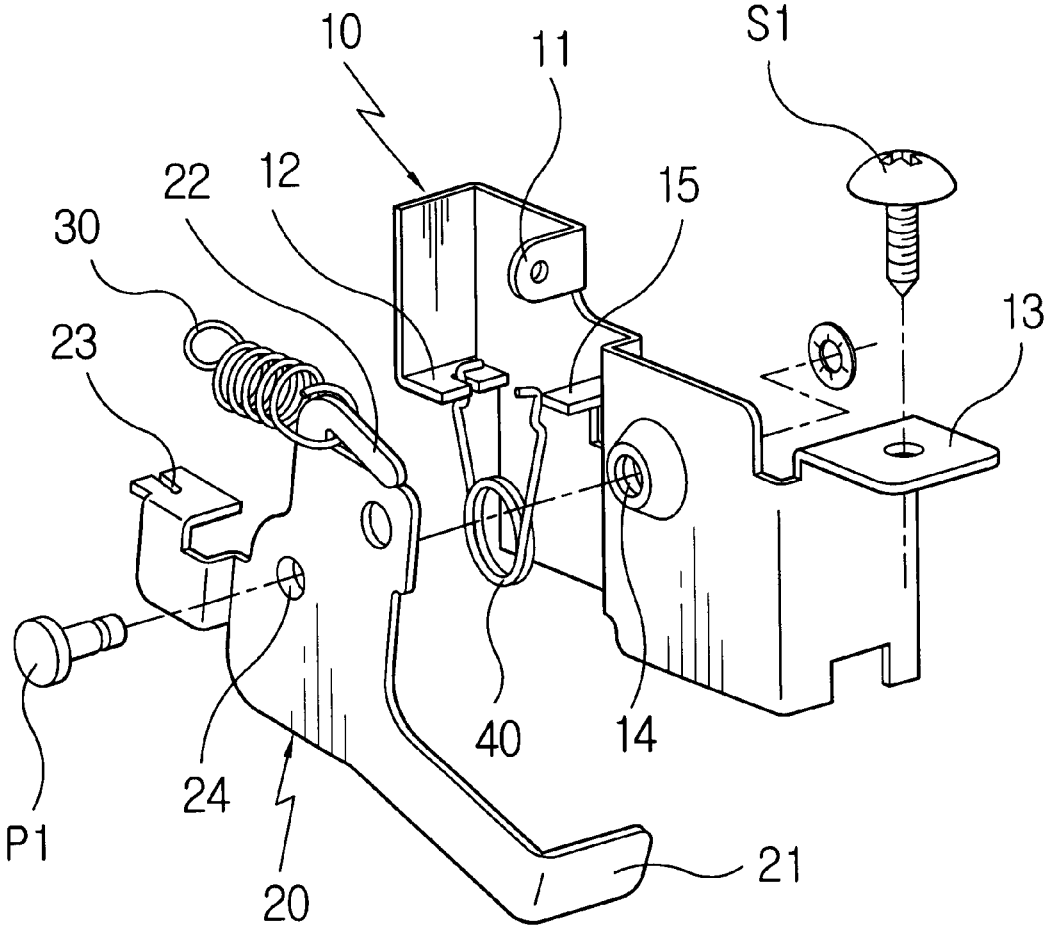
FIG. 3 shows an exploded perspective view of a major part of the invention.

A bracket 10 is bent to form spring connections 11 and 12 on its top corner and is also bent to form a securing piece 13 on the other top corner of the bracket, which securing piece is secured to the frame 5 by means of a screw S1. The bracket is also formed at a central position with a hole 14 to receive a shaft pin P1, as seen in FIGS. 2 and 3.

A blocking plate 20 is formed on the top and middle parts on its one side with spring connections 22 and 23, is formed on the bottom on its other side with an actuating piece 21 to be in contact with the bottom surface of the lever 6 and is further formed at a central position with a hole 24 for receiving a shaft pin P1. Therefore, the blocking plate 20 can be mounted to the bracket 10 pivotally by means of the shaft pin P1, wherein the blocking plate 20 may be limited in its pivotal motion by the projection 15 formed on the bracket 10 in assembled state. The spring connection 23 of the blocking plate 20 comes in contact with the projection 15 also in the assembled state.

The coil spring 30 both ends of which are respectively connected to the spring connection 11 of the bracket 10 and the spring connection 22 of the blocking plate 20 is made of such a shape-memory alloy as would undergo change in its shape at a room temperature between 20° C. and 32° C. which temperature corresponds to the levels of CO concentration of 0.01% and $CO_2$ concentration of about 1% based on the case of ordinary room heating, so that putting-out takes place well ahead of dangerous level for such harmful gases. Detailed operation in this connection will be given later.

As a shape-memory alloy suited for the coil spring 30, various alloys including Ti—Ni alloy and aluminum alloys may be mentioned. Preferably the intrinsic critical temperature may be set at an environmental temperature between 20° C. and 32° C., and particularly between 23° C. and 28° C., as suggested above.

Still referring to FIGS. 2 and 3, a bias spring 40 is connected, with its both ends, to the bracket 10 at the spring connection 12 and to the blocking plate 20 at the spring connection 23. The bias spring 40, which may be formed of a torsion spring or leaf spring, acts as a mere bias spring while helping maintenance of the hysteretic behavior for the coil spring 30 below the specific temperature below which the coil spring 30 does not operate automatically for fire putting-out but boosts the working force of the coil spring 30 by deforming in such a way as to exert force in the same direction as the force of the coil spring 30 above the above-mentioned temperature.

Figure 4A:
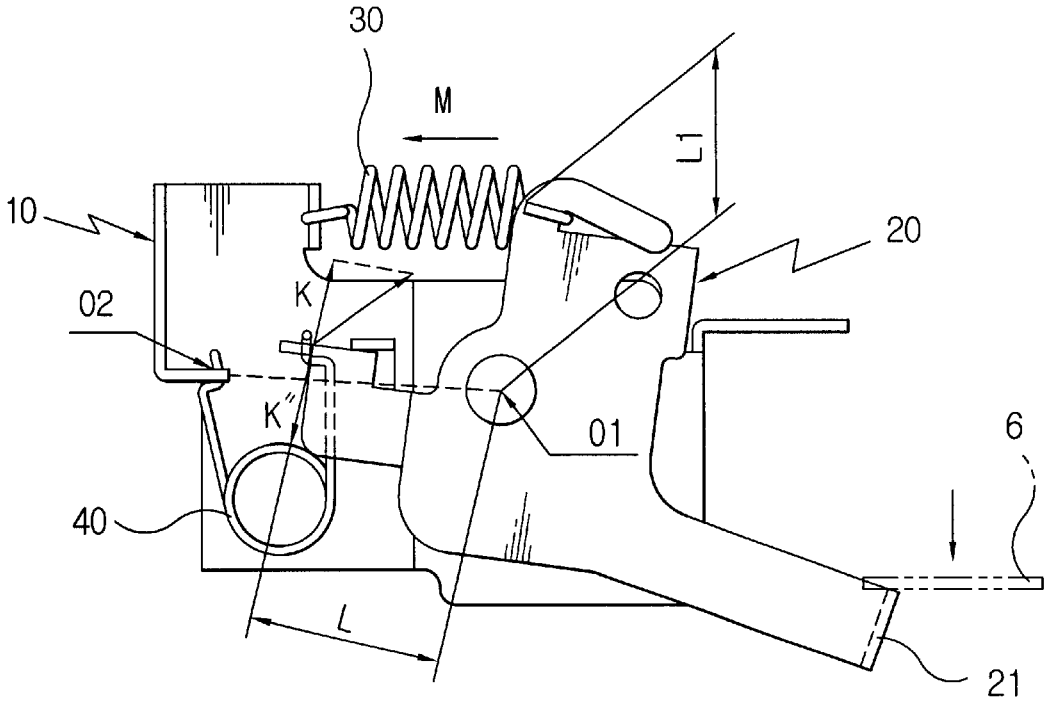
FIGS. 4*a* and 4*b* show the operative states of the present invention and FIGS. 5*a* and 5*b* show the operative states of the lever in the present invention.
Figure 4B:
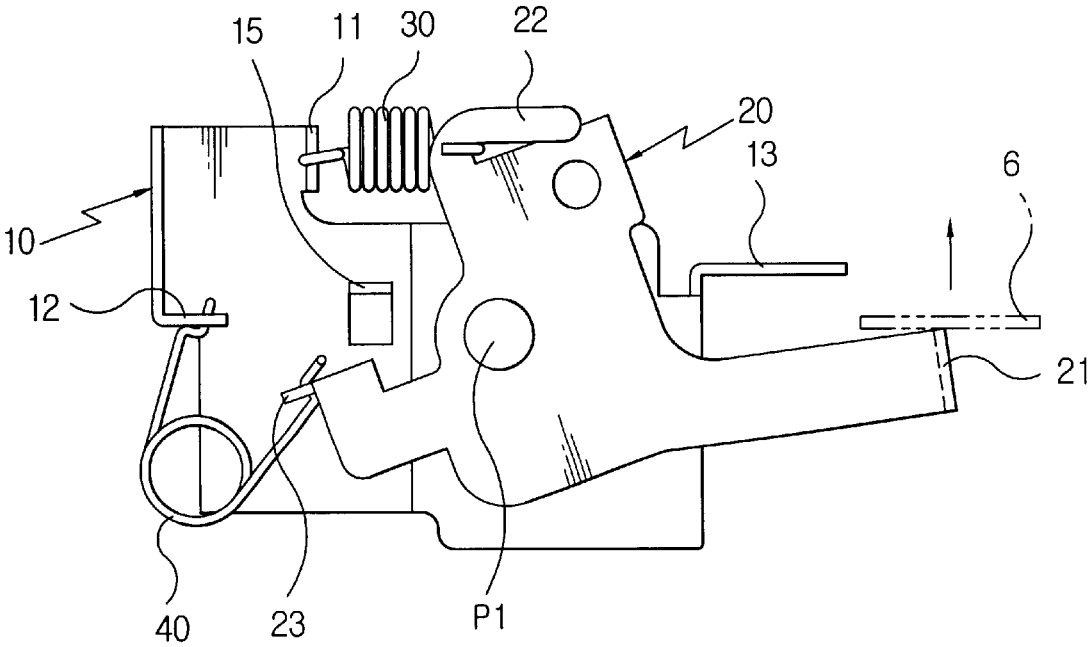

That is, in the case the torque (M×L1) by the coil spring 30 is smaller than that (K×L) by the bias spring 40, or M×L1<K×L, the blocking plate 20 makes no movement, while, if the coil spring 30 has a larger force as the temperature rises due to its shape restoring habit, or K×L<M×L1, the blocking plate 20 goes into action, as shown in FIG. 4*b*. At that time, when the position of the bias spring 40 or the connecting point 23 of the spring 40 with the blocking plate 20 crosses the center line (01–02) connecting the hinge point 12 on the bracket 10 and the hinge point 24 on the blocking plate 20, the direction of force for the bias spring 40 is reversed to be anticlockwise so that the large combined torque of M×L1 for the coil spring 30 and K×L for the bias spring 40 may act on the lever 6 for automatic hasty putting-out. Moreover, more accurate hysteresis and constant physical property for the coil spring 30 can be maintained before its temperature-dependant actuation, as the bias spring 40 can be kept within a minimum movement.

In the state, as shown in FIGS. 4*a* and 5*a*, wherein the room temperature at usual times or under room-heating condition is below the predetermined temperature for the coil spring 30, the switching bar 6*b* is engaged with the ratchet 4 under the elastic force of the leaf spring 6*a* to prevent reverse rotation of the rotation shaft 1. At this time, the lever 6 is in the lowered position at its outer end point, suppressing the actuating piece 21 of the blocking plate 20, and the coil spring 30 is in tension state, with its length expanded from its original form shown in FIG. 4*b*.

As described above, in the automatic putting-out apparatus according to the first embodiment of the invention as shown in FIGS. 1 to 5*b*, ignition is caused in the state of the wick being raised in a wick case 2 by turning the rotation shaft 1 clockwise through a grip 1*a* for heating a room, and thus the room temperature rises as the combustion continues until the preset temperature for coil spring 30 is reached, when the coil spring 30 is contracted to its original state as shown in FIG. 4*b*, whereby the blocking plate 20 is turned anticlockwise to lift up the lever 6 by means of the actuating piece 21. At this time, the operating force of the coil spring 30 is reinforced to the maximum, as the bias spring 40 changes its direction of action to agree with the coil spring 30, as mentioned above. Thus, the locking between the switching bar 6*b* on the lever 6 and the ratchet 4 is released to turn the rotation shaft 1 anticlockwise elastically due to the biased torsional force from the torsion spring 3 mounted on the ratchet 4, whereby the wick in the wick case 2 is lowered almost instantly to carry out putting-out.

On the other hand, after self putting-out is carried out due to the operation of the coil spring 6*a*, the raised lever 6 is returned to the original state under the restoring force of the leaf spring 6*a*, as shown in FIG. 5*a*, wherein the blocking plate 20, coil spring 30 and bias spring 40 are returned to normal state, as shown in FIG. 4*a*.

The automatic putting-out apparatus according to the second embodiment of the present invention is shown in FIGS. 6 to 10*b*.

The parts which are shown in FIGS. 6 to 10*b* but are of the same or similar construction or function as in the first embodiment depicted in FIGS. 1 to 5*b* are given the identical numerical numbers and excepted from further explanation.

Particularly referring to FIGS. 7 and 8, a bracket 50 is formed at the top and bottom area on its one side with a tube securing part 51 and a spring connection 52, is formed at a top area on its other side with a securing piece 53 for a screw S2 to join with a frame 5, is formed at a central position with a hole 54 for receiving a shaft pin P2 and is formed at a central top area with an operative opening 55.

A blocking plate 60 is formed at the top and bottom area on its one side with a iron wire securing part 62 and with a spring connection 63, is formed on its other side with an actuating piece 61 for contacting the bottom face of the lever 6 and is formed at a central position with a shaft hole 64 to be located inwardly of the above-described hole 54 on the wall of the bracket 50 and used for receiving the shaft pin P2 in assembled state. Thus, the blocking plate 60 is assembled to the bracket 50 pivotally through a shaft pin P2, wherein the blocking plate 60 is inserted in the operative opening 55 of the bracket 50, with its wire securing part 62 protruding from the opening.

The iron wire 70 is provided at its one end with a securing means 71 to be tightly fitted in the wire securing part 62 of the blocking part 60 and at its opposite end with a spring connector 72.

The tube 80 is fitted in tube caps 81 and 82 at opposite ends, wherein one tube cap 81 is placed in a tube securing part 51 formed in the bracket 50 and fixed by the help of a screw S3.

A spring housing 90 is composed of an upper body 90*a* and a lower body 90*b* through hooks 92 and hook slots 93 in a detachable manner. The lower body 90*b* is formed on one side with a tube securing groove 94 for receiving the other tube cap 82 of the tube 80 and to be secured with the help of a screw S4 and is formed with a spring connection 95 at top of a side wall on the other side. The upper body 90*a* is formed with vents 91 on its top wall.

A coil spring 100, in the state housed in the spring housing, is connected to the spring connection 95 of the spring housing 90 and the spring connector 72 of the iron wire 70 at opposite ends, wherein the construction and operation of such a spring according to this second embodiment are the same as those for the coil spring 30 in the first embodiment.

A bias spring 110 is connected to the spring connection 52 of the bracket 50 and the spring connection 63 of the blocking plate 60, wherein the construction and operation of such a spring according to this second embodiment are also the same as those for the bias spring 40 in the first embodiment.

In the automatic putting-out apparatus according to the second embodiment of the invention as shown in FIGS. 6 to 10*b*, ignition is initiated in the state of the wick being raised in a wick case 2 by turning the rotation shaft 1 clockwise through a grip 1*a* for heating a room, and thus the room temperature rises as the combustion continues until the predetermined temperature for coil spring 30 is reached, when the coil spring 100 is contracted to its original state, pulling the iron wire 70 housed in the tube 80, whereby the blocking plate 60 is turned anticlockwise by means of the securing means 71 to thereby lift the lever 6 through the actuating piece 61, as the shift is represented in FIGS. 9*a* and *b*. Thus, as in the case of the first embodiment, the engagement between the switching bar 6*b* on the lever 6 and the ratchet 4 is released to turn the rotation shaft 1 anticlockwise elastically due to the biased force from the torsion spring 3 mounted on the ratchet 4, whereby the wick in the wick case 2 is lowered almost instantly to carry out putting-out, as can be seen in FIGS. 10*a* and *b*.

An important feature for the automatic putting-out apparatus according to the second embodiment of the invention is that the coil spring 100 is connected to the blocking plate 60 through an iron wire 70, so that the actuating force of the coil spring 100 can be easily or flexibly transmitted to the blocking plate 60 through the iron wire 70 even in the case of a complicated construction wherein the position required for sensing the room temperature and the position suitable for installing the extinguisher are different. In that case, the iron wire 70 and tubes 80 may preferably have a suitable flexibility to be bent as required to adapt the coil spring 100 which may be located at any correct location.

The present invention which takes the advantage of shape-memory metal as one of its major characteristics as described above may have the following merits.

First, the pollution of indoor air is prevented and the safety of human body is protected from toxic gases, because the hazardous gases like CO and $CO_2$ can be kept in its concentration within the safe limit by automatically and rapidly shutting-off the combustion of the furnace.

Second, the present invention is very economical in that the present invention is of simple construction mainly based on shape-memory metal in comparison to conventional costly apparatuses employing various different components including, for example, temperature sensor, micro-switch, motor, solenoid valve and like.

Third, the present invention is safe and reliable in operation on the ground that it is operated in sheer mechanical manner irrespective of electric power in contrast to the types of conventional apparatuses based on electric circuit, which fail to function when power is off or at low level.

Fourth, the bias spring used in the present invention acts to maintain the hysteretic behavior of the coil spring below its actuation temperature and specially it exerts the force in the same direction as the coil spring made of shape-memory metal in putting-out operation at an elevated temperature. In other case, the transfer of force can be conducted easily even when the location for sensing correct temperature and the location for the putting-out device do not match.

It is to be understood that, while the invention was described mainly with respect to two specific embodiments, the invention is not just restricted to those embodiments and a variety of modifications and alterations would be possible to a man skilled in the art by referring to the description or drawings presented here and within the spirit of the invention and thus those modifications or alterations are to fall within the scope of the invention, which scope should be limited only by the attached claims.

What is claimed is:

1. An automatic combustion putting-out apparatus for a heater in a room, comprising:

a) a wick case provided with a turning shaft to raise or lower a wick;

b) a ratchet mounted on the turning shaft;

c) a torsion spring provided on the turning shaft for applying a torque to the ratchet;

d) a lever pivotally provided in a frame for releasing or arresting the ratchet;

e) a shutting-off knob and a safety weight for actuating the lever to release the ratchet to put-out a combustion;

f) a bracket provided on one side of the frame;

g) a blocking plate pivotally mounted on the bracket and including an actuating piece for contacting a bottom surface of the lever;

h) a coil spring for actuating the blocking plate by returning to its original shape when the temperature of a room rises beyond a predetermined value to put-out the combustion;

i) the coil spring being connected to the blocking plate and the bracket by the opposite ends thereof; and j) a bias spring for boosting a force applied by the coil spring when the coil spring is initiated at beyond the predetermined room temperature value, the bias spring being connected to the blocking plate and the bracket by the opposite ends thereof.

2. The apparatus according to claim 1, wherein the coil spring is formed of a shape-memory alloy.

3. The apparatus according to claim 1, wherein the coil spring changes shape at a temperature between 20° C. and 32° C. before the levels of CO and $CO_2$ in a room reach 0.01% and 1%, respectively.

4. The apparatus according to claim 1, wherein the bias spring comprises a torsion spring.

5. The apparatus according to claim 1, wherein the bias spring comprises a leaf spring.

6. An automatic combustion putting-out apparatus for a heater in a room, comprising:

a) a wick case provided with a turning shaft to raise or lower a wick;

b) a ratchet mounted on the turning shaft;

c) a torsion spring provided on the turning shaft for applying a torque to the ratchet;

d) a lever pivotally provided in a frame for releasing or arresting the ratchet;

e) a shutting-off knob and a safety weight for actuating the lever to release the ratchet to put-out a combustion;

f) a bracket provided on one side of the frame;

g) a blocking plate pivotally mounted on the bracket and including an actuating piece for contacting a bottom surface of the lever;

h) an iron wire connected to a top of the blocking plate by one end of the wire;

i) a tube for housing the iron wire and fixed to the bracket by one end of the tube;

j) a spring housing for holding the other end of the tube and including vents;

k) a coil spring provided in the spring housing for actuating the blocking plate by pulling the iron wire to return to its original shape when the temperature of a room rises beyond a predetermined value to put-out the combustion; and l) a bias spring for boosting a force applied by the coil spring when the coil spring is initiated at beyond the predetermined room temperature value, the bias spring being connected to the blocking plate and the bracket by the opposite ends thereof.

7. The apparatus according to claim 6, wherein the iron wire and the tube are bendable.

8. The apparatus according to claim 6, wherein the coil spring is formed of a shape-memory metal.

9. The apparatus according to claim 6, wherein the coil spring changes shape at a temperature between 20° C. and 32° C. before the levels of CO and $CO_2$ in a room reach 0.01% and 1%, respectively.

10. The apparatus according to claim 6, wherein the bias spring comprises a torsion spring.

11. The apparatus according to claim 6, wherein the bias spring comprises a leaf spring.

* * * * *